US010761461B2

(12) United States Patent
Morimoto

(10) Patent No.: US 10,761,461 B2
(45) Date of Patent: Sep. 1, 2020

(54) FIXING DEVICE AND IMAGE FORMING APPARATUS

(71) Applicant: KYOCERA Document Solutions Inc., Osaka (JP)

(72) Inventor: Kanako Morimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/402,378

(22) Filed: May 3, 2019

(65) Prior Publication Data

US 2019/0346795 A1 Nov. 14, 2019

(30) Foreign Application Priority Data

May 9, 2018 (JP) ..... 2018-090845

(51) Int. Cl.
*G03G 15/20* (2006.01)

(52) U.S. Cl.
CPC ..... *G03G 15/2025* (2013.01); *G03G 15/2053* (2013.01); *G03G 15/2064* (2013.01); *G03G 2215/2025* (2013.01)

(58) Field of Classification Search
CPC ..... G03G 2215/2035; G03G 15/2053; G03G 15/2025; G03G 15/2064
See application file for complete search history.

(56) References Cited

U.S. PATENT DOCUMENTS

2015/0093163 A1* 4/2015 Maruyama ..... G03G 15/2053 399/329
2015/0093167 A1* 4/2015 Hazeyama ..... G03G 15/2064 399/329
2016/0334741 A1* 11/2016 Takahashi ..... G03G 15/2053
2017/0285537 A1* 10/2017 Onaka ..... G03G 15/2053

FOREIGN PATENT DOCUMENTS

JP 2003076178 A 3/2003
JP 2003077621 A 3/2003

* cited by examiner

*Primary Examiner* — Walter L Lindsay, Jr.
*Assistant Examiner* — Jessica L Eley
(74) *Attorney, Agent, or Firm* — Studebaker & Brackett PC

(57) ABSTRACT

A fixing device includes a fixing belt, a flat heater, a holder and a pressing roller. The fixing belt is rotatable and cylindrical. The flat heater has a holding body and a heating resistor. The holder is configured to hold the flat heater such that a surface in which the heating resistor is embedded comes into contact with an inner circumferential face of the fixing belt via a lubricant. Of a contact area of the flat heater with the inner circumferential face of the fixing belt, in an area outside longitudinal end portion of the holding body, a groove is formed such that the lubricant flows to a center side of the holding body toward a downstream side in a rotational direction of the fixing belt.

9 Claims, 15 Drawing Sheets

FIG. 8
Box type (3 type)
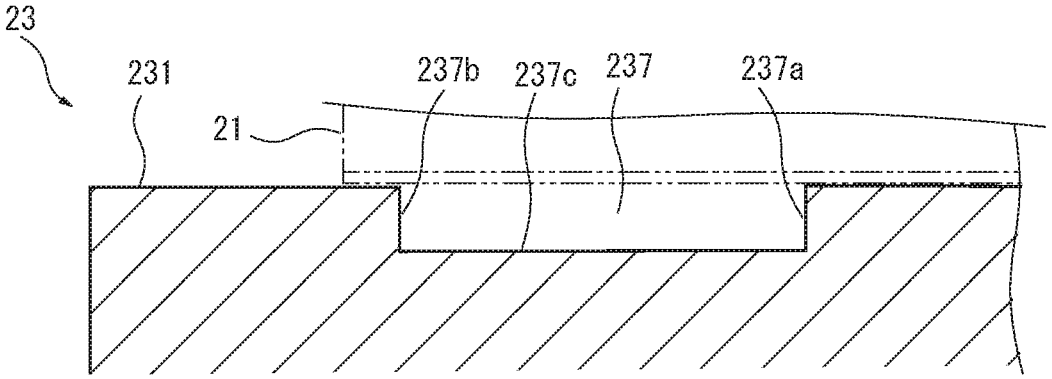
II-II
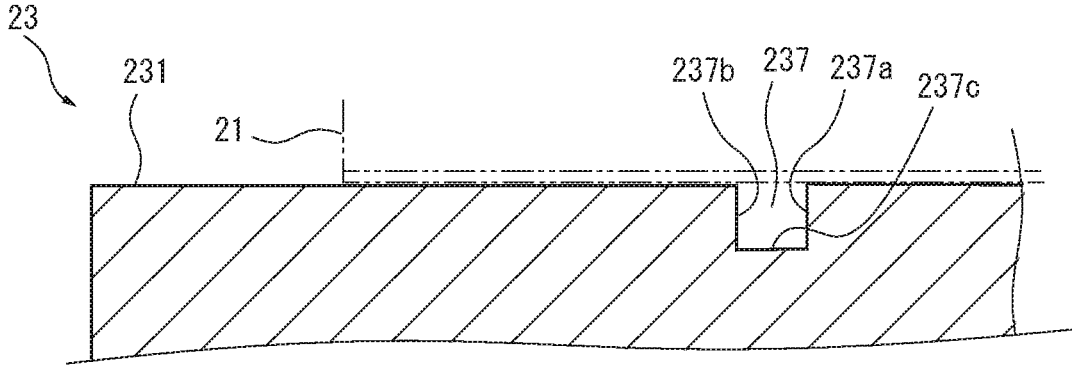
III-III
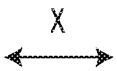
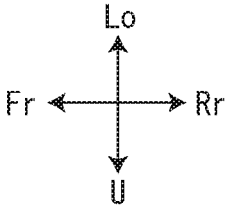

FIG. 11
Wedge type (3 type)
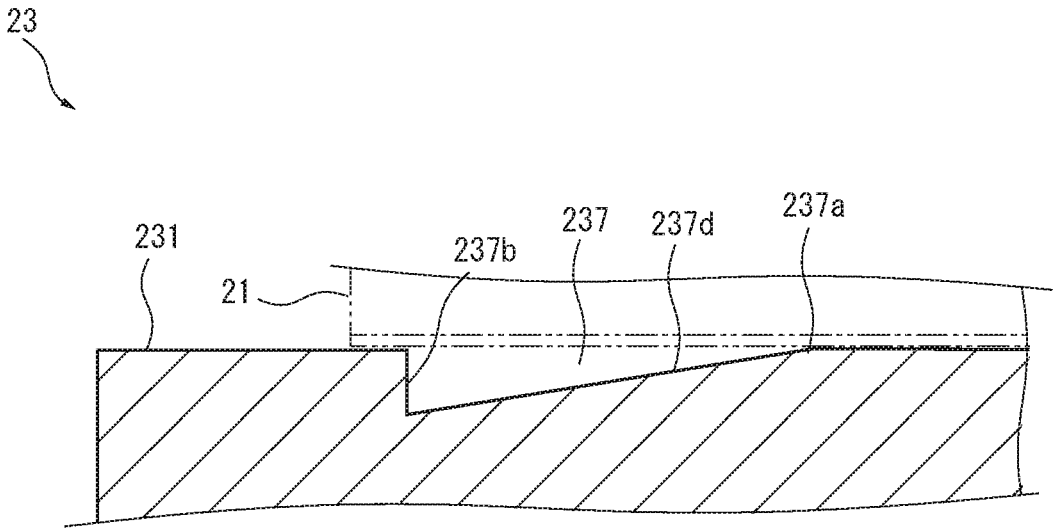
II-II
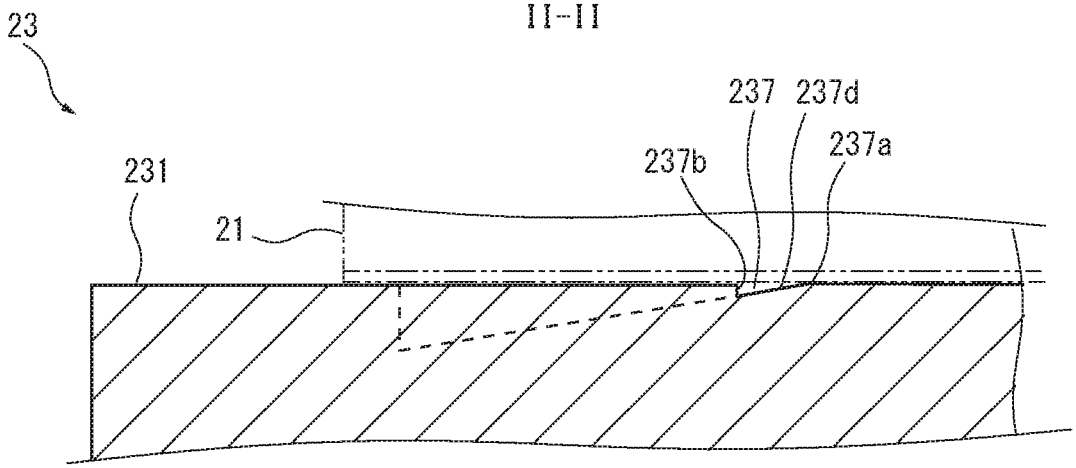
III-III
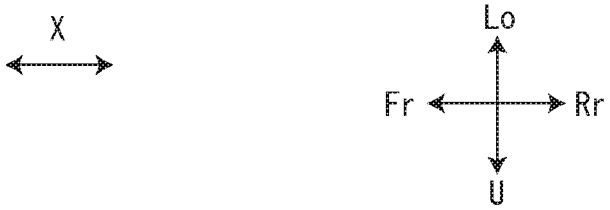

FIG. 12

RESULT OF EXPERIMENT

| | PLAN SHAPE OF GROOVE | SECTIONAL SHAPE OF GROOVE | LEAKAGE OF LUBRICANT | | |
|---|---|---|---|---|---|
| | | | AFTER 5 hrs. | AFTER 10 hrs. | AFTER 20 hrs. |
| First embodiment | 1 | box | ○ | × | × |
| Second embodiment | 2 | box | ○ | ○ | △ |
| Third embodiment | 3 | box | ○ | ○ | △ |
| Fourth emboiment | 4 | box | ○ | ○ | △ |
| Fifth embodiment | 1 | wedge | ○ | ○ | × |
| Sixth embodiment | 2 | wedge | ○ | ○ | ○ |
| Seventh embodiment | 3 | wedge | ○ | ○ | ○ |
| Eightth embodiment | 4 | wedge | ○ | ○ | ○ |
| Comparative Example | no groove | — | × | × | × |

FIG. 15
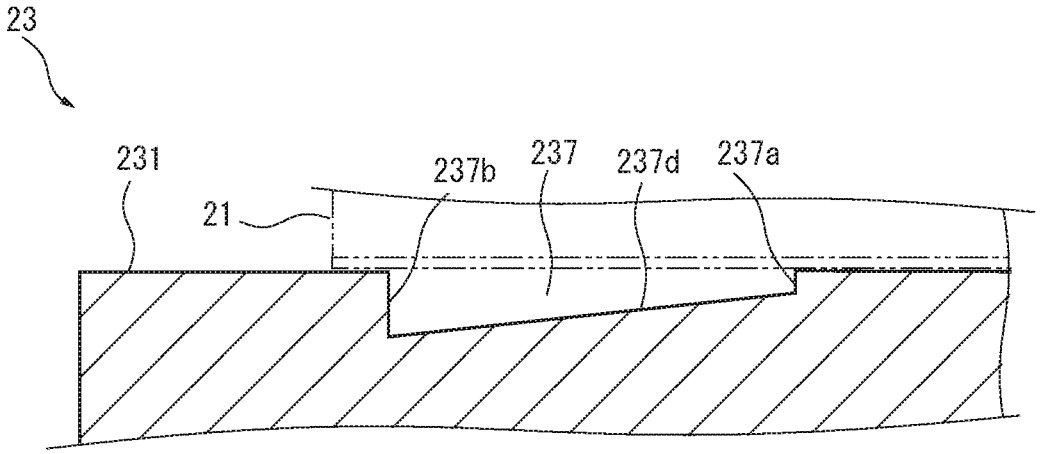
II-II
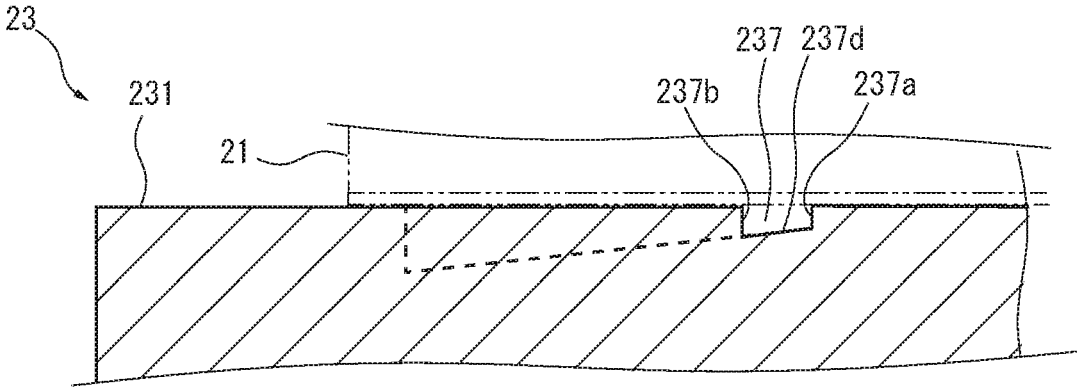
III-III
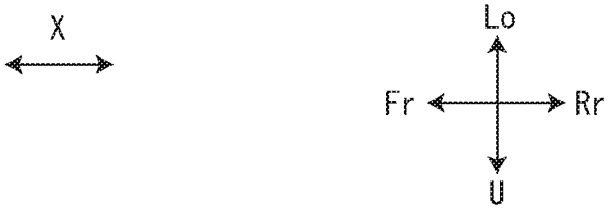

FIXING DEVICE AND IMAGE FORMING APPARATUS

INCORPORATION BY REFERENCE

This application is based on and claims the benefit of priority from Japanese Patent application No. 2018-090845, filed on May 9, 2018, which is incorporated by reference in its entirety.

BACKGROUND

The present disclosure relates to a fixing device configured to fix a toner image on a sheet and an image forming apparatus provided with the fixing device.

As one of techniques to heat a fixing belt of a fixing device, a heating technique using a flat heater is known. In a fixing device of the flat heater heating technique, a cylindrical fixing belt is put between the flat heater and a pressing roller. When the pressing roller is driven to be rotated, the fixing belt is driven by the pressing roller to be rotated. Then, a sheet on which a toner is transferred is put between the fixing belt and the pressing roller to be conveyed, and the toner is fixed on the sheet.

In the flat heater heating technique, the fixing belt is slid with respect to the flat heater. Although a lubricant is applied on an inner circumferential face of the fixing belt in order to reduce a friction to the flat heater, if the lubricant is leaked from between the fixing belt and the flat heater, the lubrication effect may be deteriorated. Then, a technique to inhibit the leakage of the lubricant from between the fixing belt and the flat heater is discussed. For example, by abrading a surface of the flat heater in a movement direction of the fixing belt, recesses are formed on the surface of the flat heater. Alternatively, grooves in an axial direction of the pressing roller or mesh-shaped grooves are formed on a sliding face of the flat heater.

However, it is difficult to inhibit the leakage of the lubricant from an end portion of an inner circumferential face of the fixing belt completely by using the above technique. When the lubricant is leaked from the end portion of the inner circumferential face of the fixing belt, the lubricant may go around an outer circumferential face of the fixing belt and be adhered on the pressing roller. Then, a grip force of the pressing roller to convey the sheet is decreased and it becomes difficult to convey the sheet.

SUMMARY

In accordance with an aspect of the present disclosure, a fixing device includes a fixing belt, a flat heater, a holder and a pressing roller. The fixing belt is rotatable and cylindrical. The flat heater has a holding body and a heating resistor. The holding body has a longitudinal length longer than a longitudinal length of the fixing belt. The heating resistor has a longitudinal length shorter than the longitudinal length of the fixing belt and is embedded in the holding body such that both longitudinal end portions of the heating resistor are positioned inside longitudinal end portions of the holding body. The holder is configured to hold the flat heater such that a surface in which the heating resistor is embedded comes into contact with an inner circumferential face of the fixing belt via a lubricant, the longitudinal end portions of the holding body are positioned outside the longitudinal end portions of the fixing belt and the longitudinal end portions of the heating resistor are positioned inside the longitudinal end portions of the fixing belt. The pressing roller is configured to hold the fixing belt between the pressing roller and the flat heater to form a pressing area between the pressing roller and the fixing belt. A sheet is conveyed through the pressing area. The fixing belt is driven by the pressing roller to be rotated. Of a contact area of the flat heater with the inner circumferential face of the fixing belt, in an area outside the longitudinal end portion of the holding body, a groove is formed such that the lubricant flows to a center side of the holding body toward a downstream side in a rotational direction of the fixing belt.

In accordance with an aspect of the present disclosure, an image forming apparatus includes an image forming part and the fixing device. The image forming part is configured to form a toner image on the sheet. The fixing device is configured to fix the toner image on the sheet.

The above and other objects, features, and advantages of the present disclosure will become more apparent from the following description when taken in conjunction with the accompanying drawings in which a preferred embodiment of the present disclosure is shown byway of illustrative example.

BRIEF DESCRIPTION OF THE DRAWINGS

FIG. 8 is cross sectional views along a II-II line and a III-III line in FIG. 7.

FIG. 11 is a cross sectional views along a II-II line and a III-III line in FIG. 7.

FIG. 12 is a view showing a result of an experiment according to the embodiment of the present disclosure.

FIG. 15 is cross sectional views along a II-II line and a III-III line in FIG. 7.

DETAILED DESCRIPTION

Hereinafter, with reference to the attached drawings, an image forming apparatus and a fixing device of the present disclosure will be described.

Figure 1:
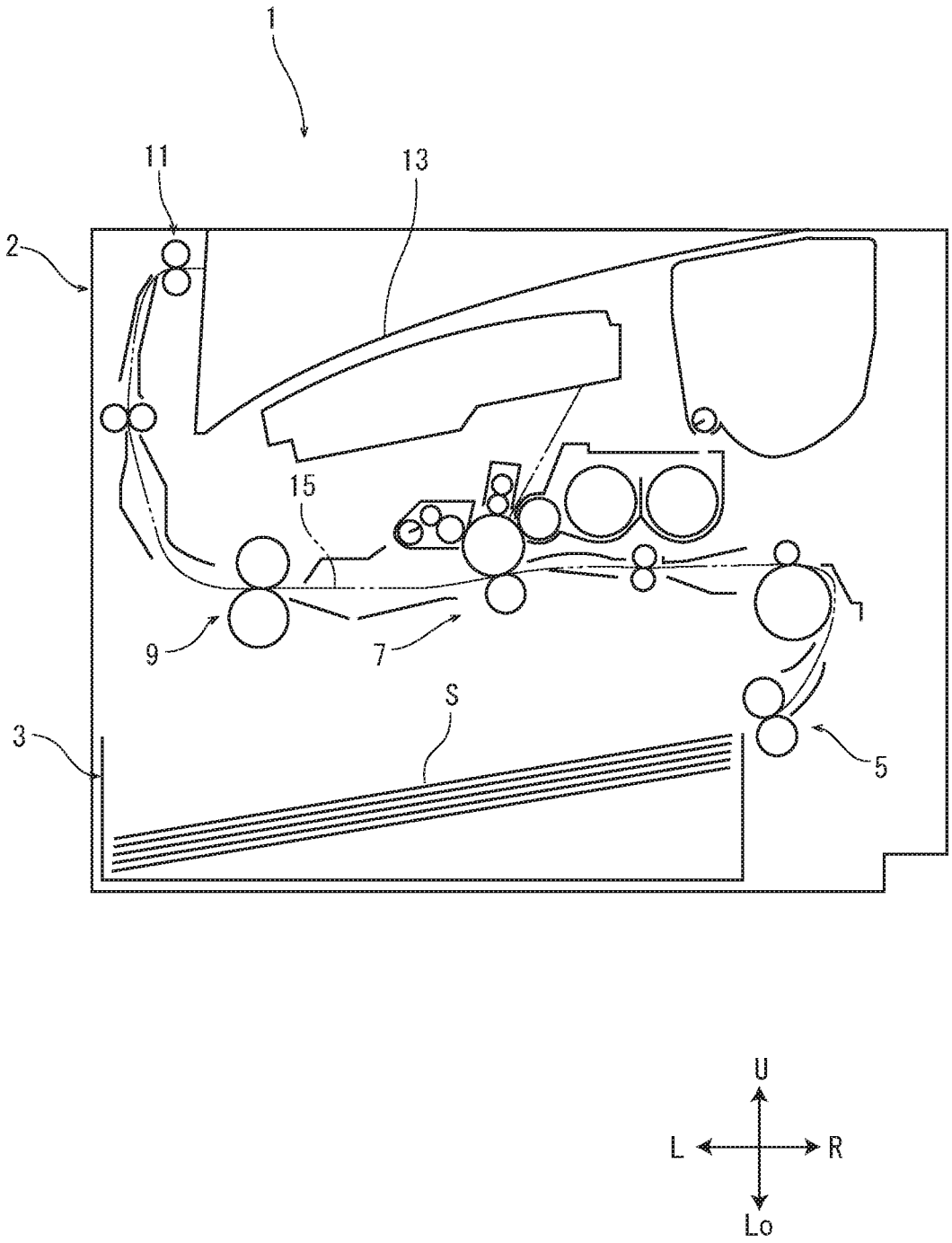
FIG. 1 is a front view schematically showing an inner structure of a printer according to an embodiment of the present disclosure.

First, with reference to FIG. 1, an entire structure of a printer 1 as the image forming apparatus will be described. FIG. 1 is a front view schematically showing an internal structure of the printer 1. In the following description, a near side of a paper surface of FIG. 1 is defined to be a front side of the printer 1, and left and right directions are based on a direction in which the printer 1 is viewed from the front side.

"U", "Lo", "L", "R", "Fr" and "Rr" in each figure respectively indicates "an upper side", "a lower side", "a left side", "a right side", "a front side", and "a rear side" of the printer 1.

An apparatus main body 2 of the printer 1 is provided with a sheet feeding cassette 3 storing a sheet S, a sheet feeding device 5 feeding the sheet S from the sheet feeding cassette 3, an image forming part 7 forming a toner image on the sheet S, a fixing device 9 fixing the toner image on the sheet S, an ejecting device 11 ejecting the sheet S and an ejected sheet tray 13 on which the ejected sheet S is stacked. In the apparatus main body 2, a conveyance path 15 for the sheet S is formed to extend from the sheet feeding device 5 to the ejecting device 11 through the image forming part 7 and the fixing device 9.

The sheet S fed from the sheet feeding cassette 3 by the sheet feeding device 5 is conveyed along the conveyance path 15 to the image forming part 7. At the image forming part 7, the toner image is formed on the sheet S. The sheet S is conveyed along the sheet conveyance path 15 to the fixing device 9. At the fixing device 9, the toner image is fixed on the sheet S. The sheet S on which the toner image is fixed is ejected by the ejecting device 11 on the ejected sheet tray 13.

Figure 2:
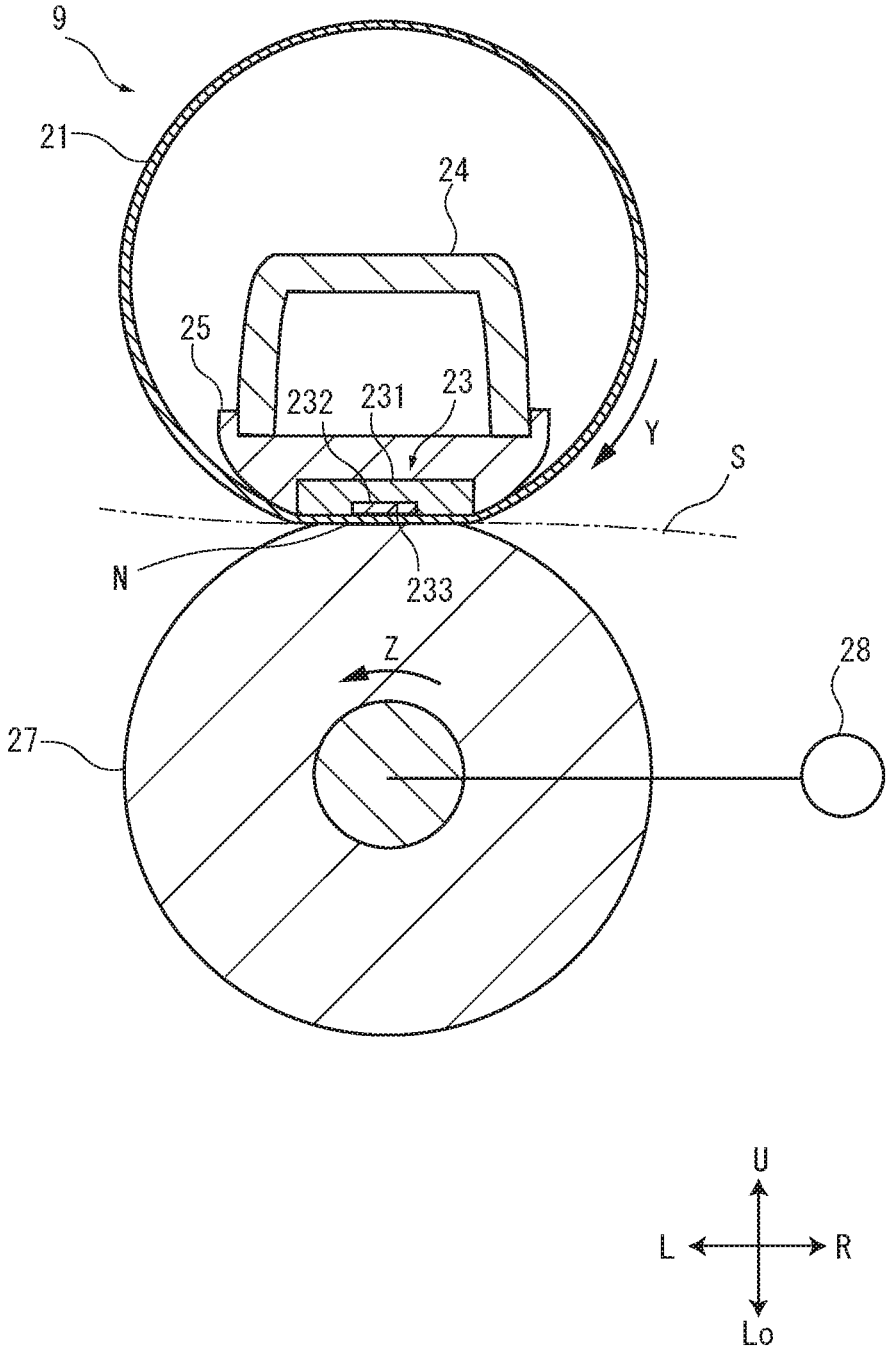
FIG. 2 is a cross sectional view showing a fixing device according to the embodiment of the present disclosure.
Figure 3:
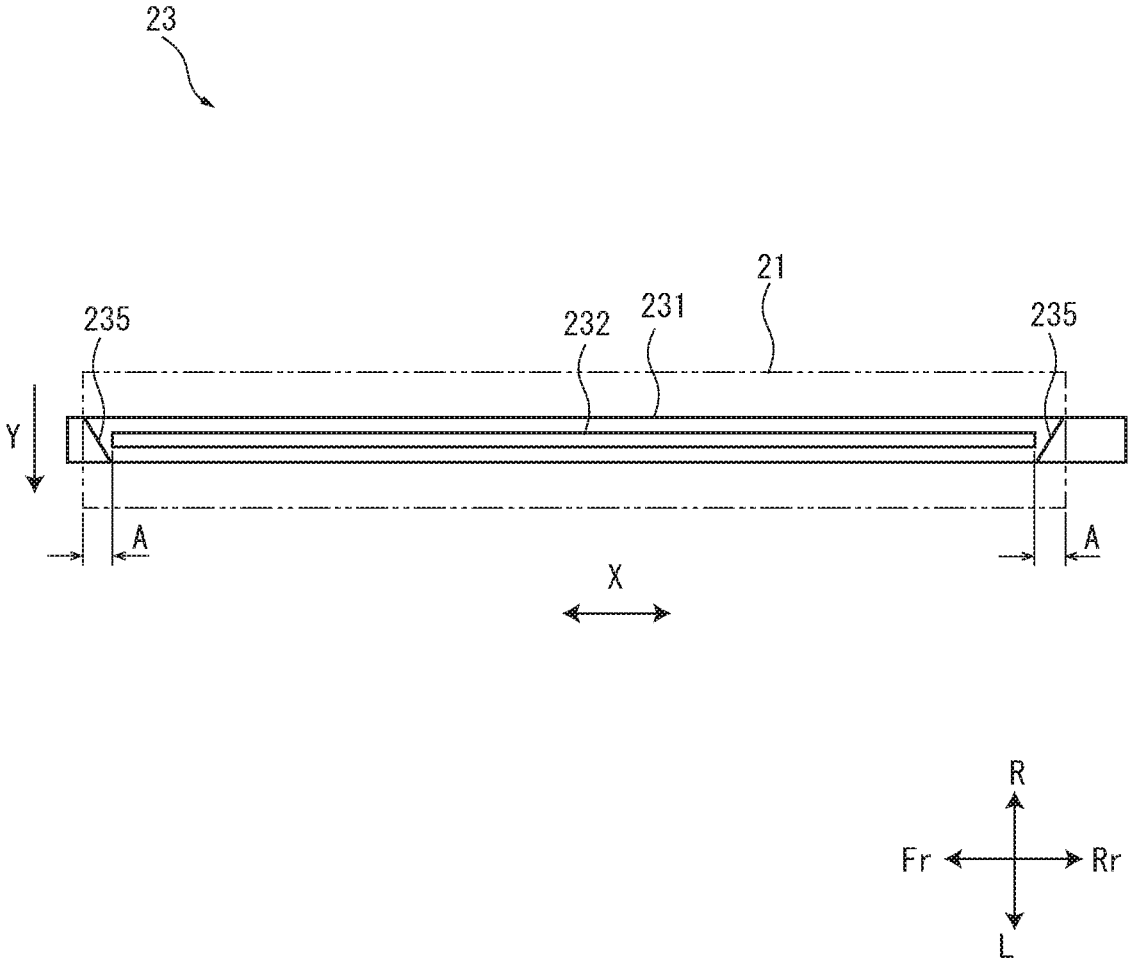
FIG. 3 is a bottom view showing a flat heater according to the embodiment of the present disclosure.

Next, with reference to FIG. 2 and FIG. 3, a structure of the fixing device 9 will be described. FIG. 2 is a cross sectional view showing the fixing device 9 and FIG. 3 is a bottom view showing a flat heater 23. The fixing device 9 includes a rotatable cylindrical fixing belt 21, a flat heater 23, a holder 25 and a pressing roller 27. The flat heater 23 heats the fixing belt 21. The holder 25 holds the flat heater 23 to come into contact with an inner circumferential face of the fixing belt 21. The fixing belt 21 is put between the pressing roller 27 and the flat heater 23, and a pressing area N through which the sheet S is conveyed is formed between the pressing roller 27 and the fixing belt 21. The pressing roller 27 drives the fixing belt 21 to rotate it. Hereinafter, an axial direction X shows an axial direction (the front-and-rear direction) of the pressing roller 27. The present embodiment shows an example where the fixing device 9 is arranged in a posture that the pressing roller 27 is positioned below the fixing belt 21; however, the fixing device 9 may be arranged in any posture.

The fixing belt 21 is a cylindrical endless belt long in the axial direction X, and has a predetermined inner diameter and a longitudinal length longer than a width of the sheet S. The fixing belt 21 is made of flexible material, and has a base layer, an elastic layer provided around an outer circumferential face of the base layer and a release layer provided around an outer circumferential face of the elastic layer. The base layer is made of metal, such as stainless steel or Ni alloy. The elastic layer is made of silicon rubber. The release layer is made of PFA tube. On an inner circumferential face of the base layer, a sliding layer may be provided. The sliding layer is made of PTFE or polyimide-amid resin.

A stay 24 is penetrated through a hollow space of the fixing belt 21, and its end portions are fixed to a housing (not shown) of the fixing device 9. The stay 24 is made of metal, such as stainless steel or Al alloy. The fixing belt 21 is supported by an arc-shaped belt guide (not shown) supported by the stay 24 and rotatable around the belt guide.

The flat heater 23 has a holding body 231 and a heating resistor 232. The holding body 231 is formed in an almost rectangular plate shape long in the axial direction X, and made of material having an electric insulating property and a low thermal conductivity, such as ceramic or glass. The heating resistor 232 is formed in an almost rectangular plate shape long in the axial direction X, and made of material having an electric conductivity, such as metal. The holding body 231 has a longitudinal length longer than the longitudinal length of the fixing belt 21 and the heating resistor 232 has a longitudinal length shorter than the longitudinal length of the fixing belt 21. On a bottom face of the holding body 231, a recess 233 having a shape corresponding to a shape of the heating resistor 232 is formed. The heating resistor 232 is embedded in the recess 233. Both longitudinal end portion of the heating resistor 232 are positioned inside both longitudinal end portions of the holding body 231. On the bottom face of the holding body 231, a protect layer (not shown) is formed in order to protect the heating resistor 232 and the holding body 231. The protect layer is made of glass.

The holder 25 is a member having almost the same longitudinal length as the longitudinal length of the fixing belt 21, and is fixed to the stay 24. The holder 25 is made of heat resistant resin, such as liquid crystal polymer. The flat heater 23 is supported by a lower portion of the holder 25 with the heating resistor 232 facing downward. The holder 25 holds the flat heater 23 such that the bottom face (the face in which the heating resistor 232 is embedded) brings contact with the inner circumferential face of the fixing belt 21, both the longitudinal end portions of the holding body 231 are positioned outside both the longitudinal end portions of the fixing belt 21 and both the longitudinal end portions of the heating resistor 232 are inside both the longitudinal end portions of the fixing belt 21.

The pressing roller 27 includes a core metal, an elastic layer provided around an outer circumferential face of the core metal and a release layer provided around an outer circumferential face of the elastic layer. The elastic layer is made of silicon rubber. The release layer is made of PFA tube. The pressing roller 27 is supported to be pressed against the flat heater 23 via the fixing belt 21. The pressing roller 27 is driven by a drive source 28, such as a motor, to be rotated.

A fixing operation of the fixing device 9 having the above configuration will be described. When the pressing roller 27 is driven to be rotated in a predetermined rotational direction Z, the fixing belt 21 is driven by the pressing roller 27 to be rotated in a rotational direction Y counter to the rotational direction of the pressing roller 27, and the inner circumferential face of the fixing belt 21 is slid with respect to the flat heater 23. When electric power is supplied to the flat heater 23, the fixing belt 21 is heated. After the fixing belt 21 is heated to a predetermined temperature, the sheet S on which the toner is transferred is conveyed to the pressing area N. At the pressing area N, the sheet S is put between the fixing belt 21 and the pressing roller 27 and then conveyed. At this time, the toner is heated and pressed by the fixing belt 21 to be fixed on the sheet S. The sheet S on which the toner is fixed is separated from the fixing belt 21 and then conveyed along the conveyance path 15.

Next, by employing a first to an eighth embodiments 1 to 8, a groove 235 formed in the flat heater 23 will be described.

A First Embodiment

Figure 4:
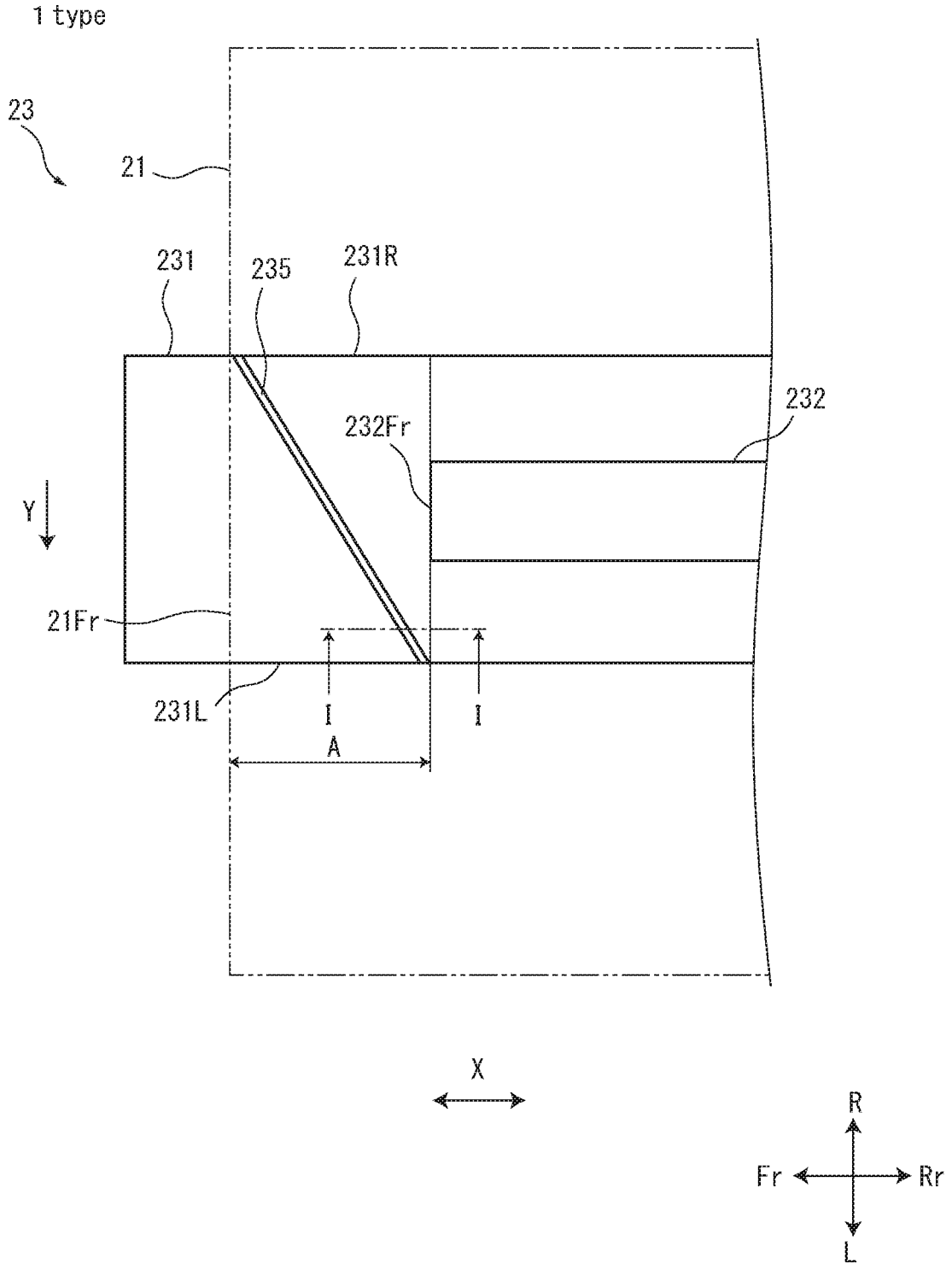
FIG. 4 is a bottom view showing the flat heater according to the embodiment of the present disclosure.
Figure 5:
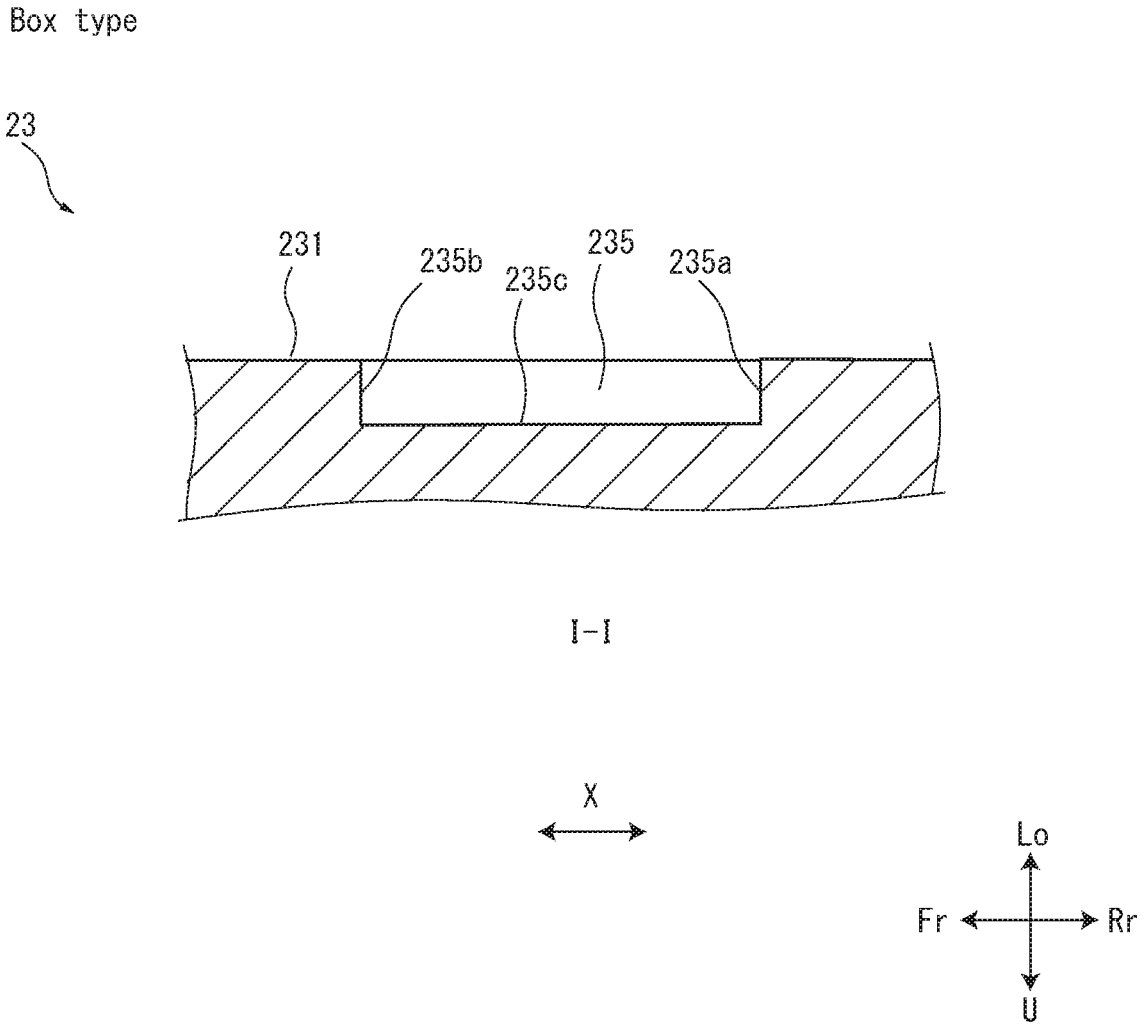
FIG. 5 is a cross sectional view along a I-I line in FIG. 4.

With reference to FIG. 3 to FIG. 5, the first embodiment will be described. FIG. 4 is a bottom view showing the flat heater 23. FIG. 5 is a cross sectional view along a I-I line in FIG. 4. Here, a groove 235 formed in a front portion of the flat heater 23 will be described; the groove 235 formed in a rear portion has the same structure as that formed in the front portion, except whose front-and-rear direction is inverted.

In the first embodiment, of a contact area of the flat heater 23 with the inner circumferential face of the fixing belt 21, an area (hereinafter, called an outside area A) outside the heating resistor 232 in the longitudinal direction is formed with the groove 235. The groove 235 is formed to be closer to a center side of the holding body 231 toward a downstream side in the rotational direction Y of the fixing belt 21. Thereby, a lubricant applied between the fixing belt 21 and the flat heater 23 flows toward the center side of the holding body 231 as it flows toward the downstream side in the rotational direction Y of the fixing belt 21.

Specifically, as shown in FIG. 4, the outside area A is a rectangular area surrounded by a left end 231L and a right end 231R of the holding body 231, a front end 21Fr of the fixing belt 21 and a straight line containing a front end 232Fr of the heating resistor 232, of the bottom face of the holding body 231. The groove 235 is formed to extend linearly from near a right front apex to near a left rear apex of the outside area A. An upstream side end portion and a downstream side end portion of the groove 235 in the rotational direction Y are opened to an upstream side face and a downstream side face of the holding body 231. Hereinafter, a plan shape of the groove 235 shown in FIG. 4 is called a 1 type.

As shown in FIG. 5, the groove 235 has edge portions 235*a* and 235*b* each formed in a wall shape perpendicular to the bottom face of the holding body 231 and a bottom face 235*c* parallel to the bottom face of the holding body 231. Hereinafter, a cross sectional shape of the groove 235 shown in FIG. 5 is called a box type.

According to the first embodiment, the lubricant applied between the fixing belt 21 and the flat heater 23 in the outside area A flows toward the downstream side in the rotational direction Y by the rotation of the fixing belt 21. At this time, a part of the lubricant enters the groove 235 and then flows toward the center side of the holding body 231 along the groove 235. Accordingly, compared with a case having no groove 235, an amount of the lubricant which flows on an area outside the groove 235 in the longitudinal direction of the holding body 231 is decreased. Then, according to the first embodiment, compared with a case having no groove 235, it becomes possible to inhibit a leakage of the lubricant from the end portion of the inner circumferential face of the fixing belt 21. As a result, a situation hardly occurs, where the leaked lubricant goes around the outer circumferential face of the fixing belt 21 and it becomes difficult to convey the sheet S.

Because the groove 235 is formed in the area outside the heating resistor 232 in the longitudinal direction of the holding body 231, of the contact area of the flat heater 23 with the inner circumferential face of the fixing belt 21, a temperature unevenness hardy occurs. On the other hand, when the groove 235 is formed on the protect layer provided on the surface of the heating resistor 232, the temperature unevenness may occur.

A Second Embodiment

Figure 6:
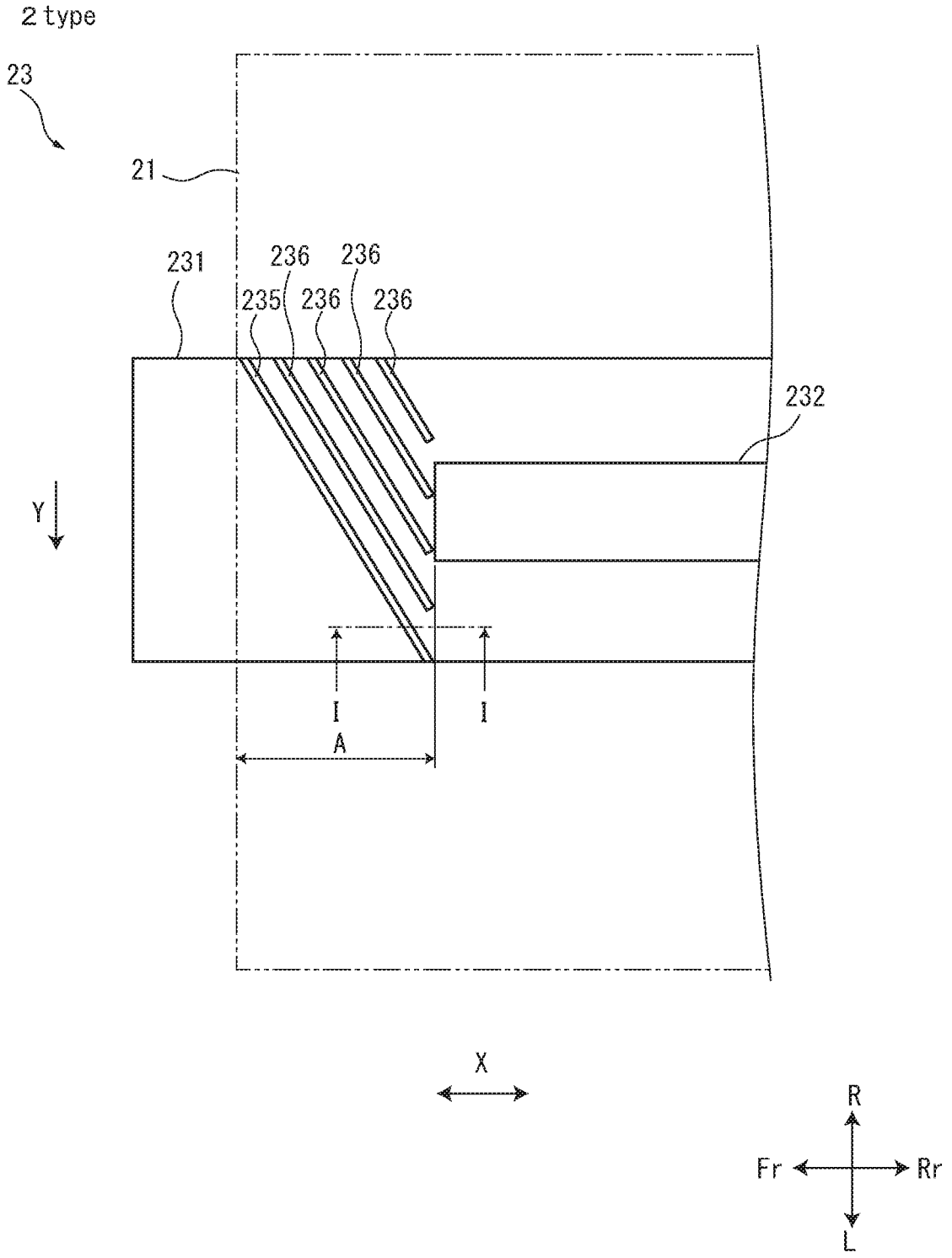
FIG. 6 is a bottom view showing the flat heater according to the embodiment of the present disclosure.

With reference to FIG. 6, the second embodiment will be described. FIG. 6 is a bottom view showing the flat heater 23. In the second embodiment, a plurality of grooves 235 and 236 is disposed side by side in the longitudinal direction of the holding body 231. Specifically, a plurality of grooves 236 each having the same configuration as that of the groove 235 is formed in the outside area A, in addition to the groove 235 of the first embodiment. The plurality of grooves 236 is formed to be closer to the center side of the holding body 231 than the groove 235. The grooves 235 and 236 are formed in parallel to each other. The upstream side end portion of the groove 236 in the rotational direction Y is opened to the upstream side face of the holding body 231; the downstream side end portion of the groove 236 in the rotational direction Y is not opened to the downstream side face of the holding body 231. Hereinafter, a plan shape of the groove shown in FIG. 6 is called a 2 type. A cross sectional shape of the groove 236 is the same box type as the groove 235.

According to the second embodiment, a part of the lubricant enters the grooves 235 and 236 and then flows toward the center side of the holding body 231 along the grooves 235 and 236. Accordingly, compared with the first embodiment, an amount of the lubricant which flows on the area outside the groove 235 in the longitudinal direction of the holding body 231 is decreased. Then, according to the second embodiment, compared with the first embodiment, it becomes possible to inhibit the leakage of the lubricant from the end portion of the inner circumferential face of the fixing belt 21.

A Third Embodiment

Figure 7:
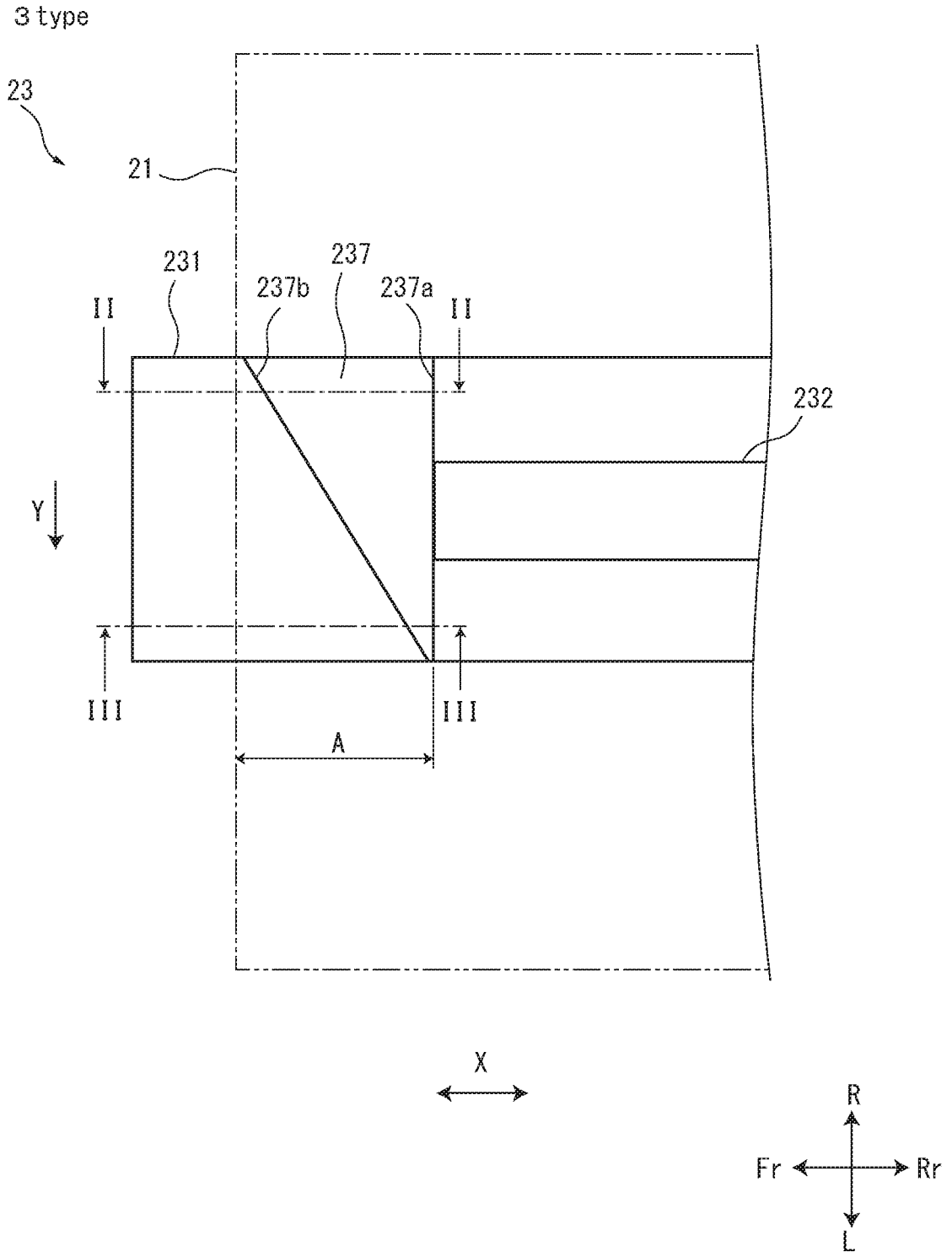
FIG. 7 is a bottom view showing the flat heater according to the embodiment of the present disclosure.

With reference to FIG. 7 and FIG. 8, the third embodiment will be described. FIG. 7 is a bottom view showing the flat heater 23. FIG. 8 is cross sectional views along a II-II line and a line in FIG. 7. A groove 237 in the third embodiment is formed in a right angled triangle whose width becomes narrower toward the downstream side in the rotational direction Y of the fixing belt 21. Of an inside edge portion 237*a* close to the heating resistor 232 and an outside edge portion 237*b* far from the heating resistor 232 of the groove 237, the outside edge portion 237*b* is formed to be closer to the center side of the holding body 231 toward the downstream side in the rotational direction Y of the fixing belt 21.

Specifically, as shown in FIG. 7, the outside edge portion 237*b* is formed to extend linearly from near the right front apex to near the left rear apex of the outside area A. On the other hand, the inside edge portion 237*a* is formed to be linearly parallel to the longitudinal end face of the heating resistor 232. Hereinafter, a plan shape of the groove shown in FIG. 7 is called a 3 type.

As shown in FIG. 8, the inside edge portion 237*a* and the outside edge portion 237*b* each are formed in a wall shape perpendicular to the bottom face of the holding body 231. The groove 237 has a bottom face 237*c* parallel to the bottom face of the holding body 231. A distance between the inside edge portion 237*a* and the outside edge portion 237*b* becomes shorter toward the downstream side in the rotational direction Y of the fixing belt 21. Hereinafter, a cross sectional shape of the groove shown in FIG. 8 is called a box type (a 3 type). An upstream side end portion and a downstream side end portion of the groove 237 in the rotational direction Y are opened to the upstream side face and the downstream side face of the holding body 231.

According to the third embodiment, a part of the lubricant enters the groove 237 and then flows to the center side of the holding body 231 along the groove 237. Because the groove 237 is formed in an area including the grooves 235 and 236 in the second embodiment, according to the third embodiment, it becomes possible to inhibit the leakage of the lubricant from the end portion of the inner circumferential face of the fixing belt 21 more than the second embodiment.

A Fourth Embodiment

Figure 9:
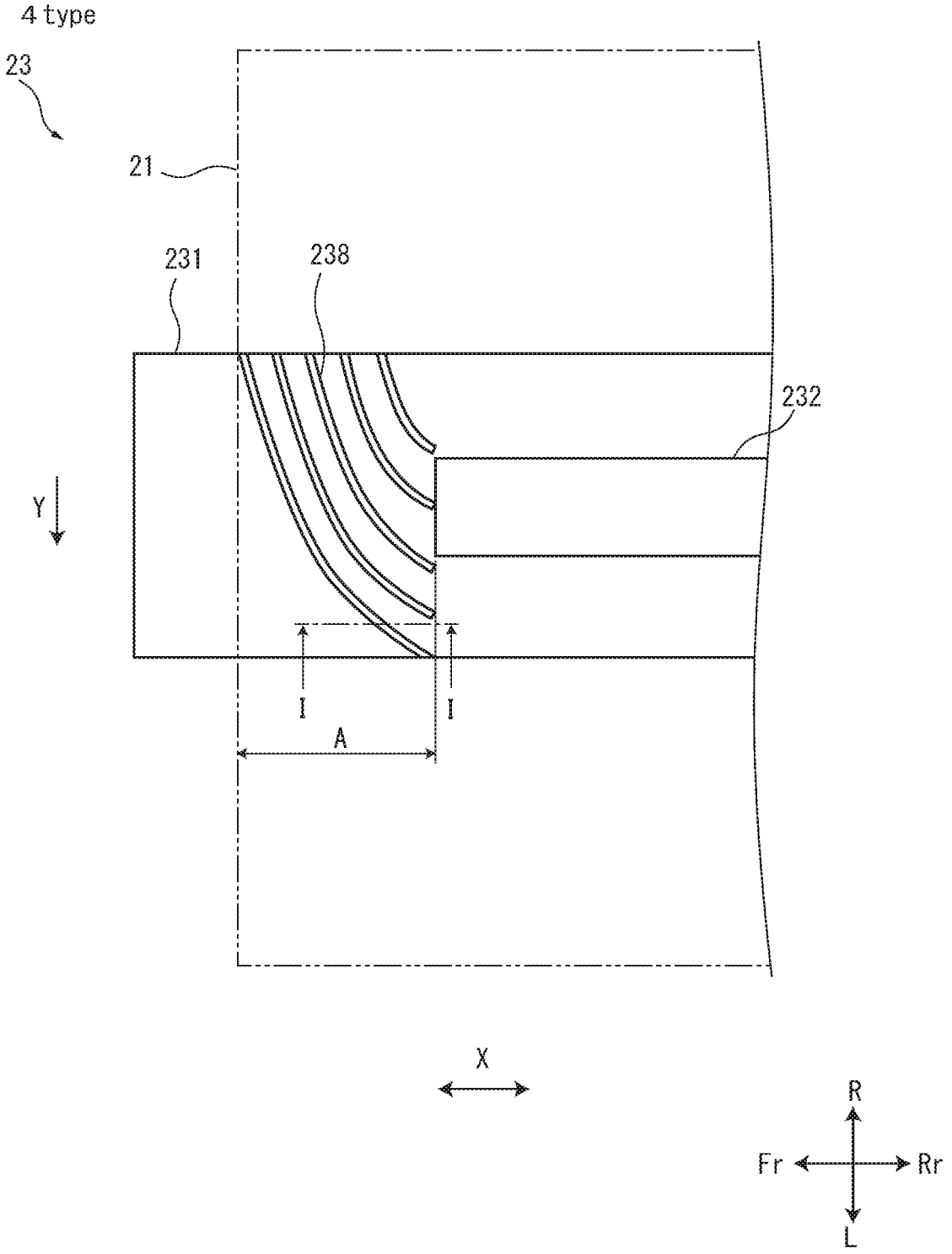
FIG. 9 is a bottom view showing the flat heater according to the embodiment of the present disclosure.

With reference to FIG. 9, the forth embodiment will be described. FIG. 9 is a bottom view showing the flat heater 23. In the fourth embodiment, a plurality of grooves 238 each curved toward the center side of the holding body 231 is disposed side by side in the longitudinal direction of the holding body 231.

Specifically, the groove 238 is formed to be closer to the center side of the holding body 231 toward the downstream side in the rotational direction Y of the fixing belt 21. The groove 238 is formed in a curve line curved toward the center side of the holding body 231, and its curvature becomes large toward the downstream side in the rotational direction Y of the fixing belt 21. Upstream side end portions of the grooves 238 in the rotational direction Y penetrate through the holding body 231. Of the grooves 238, the downstream side end portion of the outermost groove 238 in the rotational direction Y is opened to the downstream side face of the holding body 231, and the downstream side end portions of the other grooves 238 in the rotational direction Y are not opened to the downstream side face of the holding body 231. Hereinafter, a plan view of the groove 238 shown in FIG. 9 is called a 4 type. A cross section of the groove 238 is the same box type as that of the groove of the first embodiment 1.

According to the fourth embodiment, because the groove 238 is curved toward the center side of the holding body 231, the flowing of the lubricant entered the groove 238 toward the center side of the holding body 231 is promoted compared with the second embodiment. Furthermore, because the groove 238 has a length longer than the length of the grooves 235 and 236, an amount of the lubricant entered the groove 238 is larger than that in the second embodiment. Accordingly, it becomes possible to inhibit the leakage of the lubricant from the end portion of the inner circumferential face of the fixing belt 21 more than the second embodiment.

A Fifth Embodiment

Figure 10:
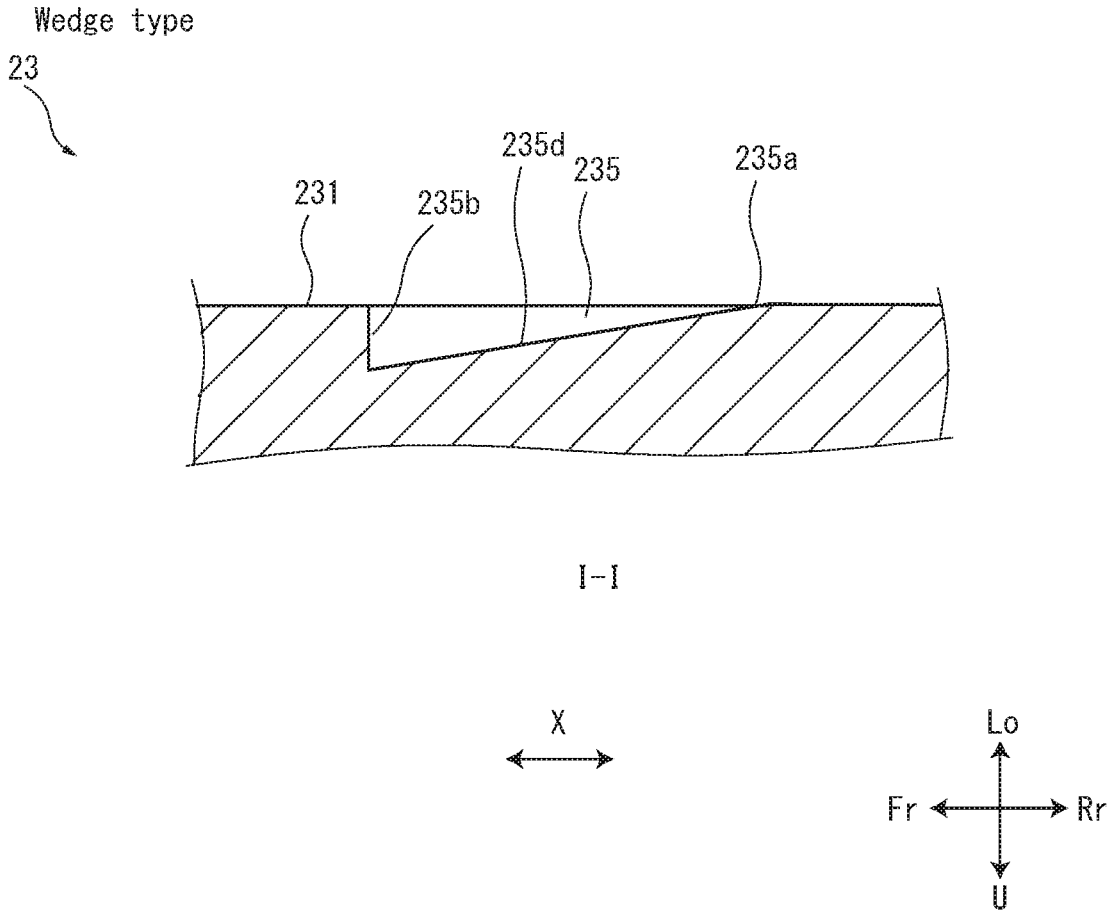
FIG. 10 is a cross sectional view along a I-I line in FIG. 4.

With reference to FIG. 4 and FIG. 10, the fifth embodiment will be described. FIG. 10 is a cross sectional view along a I-I line in FIG. 4. In the fifth embodiment, the cross section of the groove 235 in the first embodiment is changed into a cross section shown in FIG. 10. In the fifth embodiment, the groove 235 is formed to become shallower toward the center side of the holding body 231 in a direction crossing to the longitudinal direction of the groove 235.

Specifically, of the inside edge portion 235*a* close to the heating resistor 232 and the outside edge portion 235*b* far from the heating resistor 232 of the groove 235, the outside edge portion 235*b* is formed to a wall shape perpendicular to the bottom face of the holding body 231. From a lower end of the outside edge portion 235*b*, an inclined face 235*d* upwardly to the center side of the holding body 231 is formed. The inclined face 235*d* reaches the bottom face of the holding body 231, and the inside edge portion 235*a* has no step. Hereinafter, a cross sectional shape of the groove 235 shown in FIG. 10 is called a wedge type.

According to the fifth embodiment, the lubricant applied between the fixing belt 21 and the flat heater 23 in the outside area A flows toward the downstream side in the rotational direction Y by the rotation of the fixing belt 21. At this time, a part of the lubricant enters the groove 235 and then flows toward the center side of the holding body 231. Because the groove 235 is formed to become shallower toward the center side of the holding body 231 in the direction crossing to the longitudinal direction of the groove 235, as compared with the first embodiment, the lubricant entered the groove 235 easily overflows to the center side of the holding body 231 and the flowing of the lubricant toward the center side of the holding body 231 is promoted. Then according to the fifth embodiment, compared with the first embodiment, it becomes possible to inhibit the leakage of the lubricant from the end portion of the inner circumferential face of the fixing belt 21.

A Sixth Embodiment

With reference to FIG. 6 and FIG. 10, the sixth embodiment will be described. In the sixth embodiment, the cross sectional shape of each of the grooves 235 and 236 in the second embodiment is changed into the cross sectional shape shown in FIG. 10. The groove 235 is formed to become shallower toward the center side of the holding body 231 in the direction crossing to the longitudinal direction of the groove 235. The groove 236 is formed to become shallower toward the center side of the holding body 231 in the direction crossing to the longitudinal direction of the groove 236. According to the sixth embodiment, compared with the second embodiment, the flowing of the lubricant toward the center side of the holding body 231 is promoted. Then, according to the sixth embodiment, compared with the second embodiment, it becomes possible to inhibit the leakage of the lubricant from the end portion of the inner circumferential face of the fixing belt 21.

A Seventh Embodiment

With reference to FIG. 7 and FIG. 11, the seventh embodiment will be described. FIG. 11 is cross sectional views along a II-II line and along a III-III line in FIG. 7. In the seventh embodiment, the cross sectional shape of the groove 237 in the third embodiment is changed into a cross sectional shape shown in FIG. 11. In the seventh embodiment, the groove 237 is formed to become shallower toward the center side of the holding body 231 in a direction crossing to a longitudinal direction of the groove 237.

Specifically, of the inside edge portion 237*a* close to the heating resistor 232 and the outside edge portion 237*b* far from the heating resistor 232 of the groove 237, the outside edge portion 237*b* is formed to a wall shape perpendicular to the bottom face of the holding body 231. From a lower end of the outside edge portion 237*b*, an inclined face 237*d* upwardly to the center side of the holding body 231 is formed. The inclined face 237*d* reaches the bottom face of the holding body 231, and the inside edge portion 237*a* has no step. Hereinafter, a cross sectional shape of the groove 237 shown in FIG. 11 is called a wedge type (a 3 type). According to the seventh embodiment, as compared with the third embodiment, the flowing of the lubricant toward the center side of the holding body 231 is promoted. Then, according to the seventh embodiment, compared with the third embodiment, it becomes possible to inhibit the leakage of the lubricant from the end portion of the inner circumferential face of the fixing belt 21.

A Eighth Embodiment

With reference to FIG. 9 and FIG. 10, the eighth embodiment will be described. In the eighth embodiment, the cross sectional shape of the groove 238 in the fourth embodiment is changed into the cross sectional shape shown in FIG. 10. The groove 238 is formed to become shallower toward the center side of the holding body 231 in the direction crossing to the longitudinal direction of the groove 238. According to the eighth embodiment, compared with the fourth embodiment, the flowing of the lubricant toward the center side of the holding body 231 is promoted. Then, according to the eighth embodiment, compared with the fourth embodiment, it becomes possible to inhibit the leakage of the lubricant from the end portion of the inner circumferential face of the fixing belt 21.

<Result of Experiment> Next, with reference to FIG. 12, a result of experiment of the first to the eighth embodiments will be described. FIG. 12 is a table showing the result of the experiment. A comparative example shown in FIG. 12 shows a result of an experiment in a case where the groove is not formed in the outside area A. A circumferential speed of the fixing belt 21 is set to 400 mm/sec, and after continuous driving of the fixing belt 21 for 5, 10 and 20 hours, a degree of the leakage of the lubricant from the end portion of the fixing belt 21 is judged. A surface temperature of the fixing belt 21 during the continuous driving is set to about 175° c. At an initial state before the continuous driving, a lubricant of 0.7 g is applied on the flat heater 23 uniformly. As the lubricant, fluorine-based grease is employed.

The degree of the leakage of the lubricant is evaluated based on three steps. A step "0" shows no leakage of the lubricant or a degree where the leakage of the lubricant is not affected on the conveyance of the sheet. A step "A" shows a degree where the leakage of the lubricant begins to be affected on the conveyance of the sheet. A step "x" shows a degree where the conveyance of the sheet becomes difficult owing to the leakage of the lubricant. In Comparative Example, the steps of the degrees of the lubricant after 5, 10 and 20 hours are judged as "x". In the first embodiment, the step of the degree of the leakage of the lubricant after 5 hours is judged as "0"; however, that after 10 and 20 hours are judged as "x". In the second to the fourth embodiments, the steps of the degrees of the leakage of the lubricant after 5 and 10 hours are judged as "0"; however, that after 20 hours is judged as "A". In the sixth to the eighth embodiments, the steps of the degrees of the leakage of the lubricant after 5, 10 and 20 hours are judged as "o".

Compared the first embodiment with Comparative Example, it was confirmed that the groove of the present embodiment has an effect to inhibit the leakage of the lubricant. Next, compared the first to the fourth embodiments each other, each having the cross sectional shape of the box type, it was confirmed that the 2 to 4 types have the effect to inhibit the leakage of the lubricant higher than the 1 type. Next, compared the fifth to the eighth embodiments each other, each having the cross sectional shape of the wedge type, it was confirmed that the 2 to 4 types have the effect to inhibit the leakage of the lubricant higher than the 1 type. Next, compared with the first embodiment with the fifth embodiment, each having the plan shape of the 1 type, it was confirmed that the wedge type has the effect to inhibit the leakage of the lubricant higher than the box type. Next, compared the second embodiment with the sixth embodiment, each having the plan shape of the 2 type, compared the third embodiment with the seventh embodiment, each having the plan shape of the 3 type, and compared the fourth embodiment with the eighth embodiment, each have the plan shape of the 4 type, it was confirmed that the wedge type has the effect to inhibit the leakage of the lubricant higher than the box type. As described above, it was confirmed that the 2 to 4 types have the effect to inhibit the leakage of the lubricant higher than the 1 type and the wedge type has the effect to inhibit the leakage of the lubricant higher than the box type.

Modified Example

Figure 13:
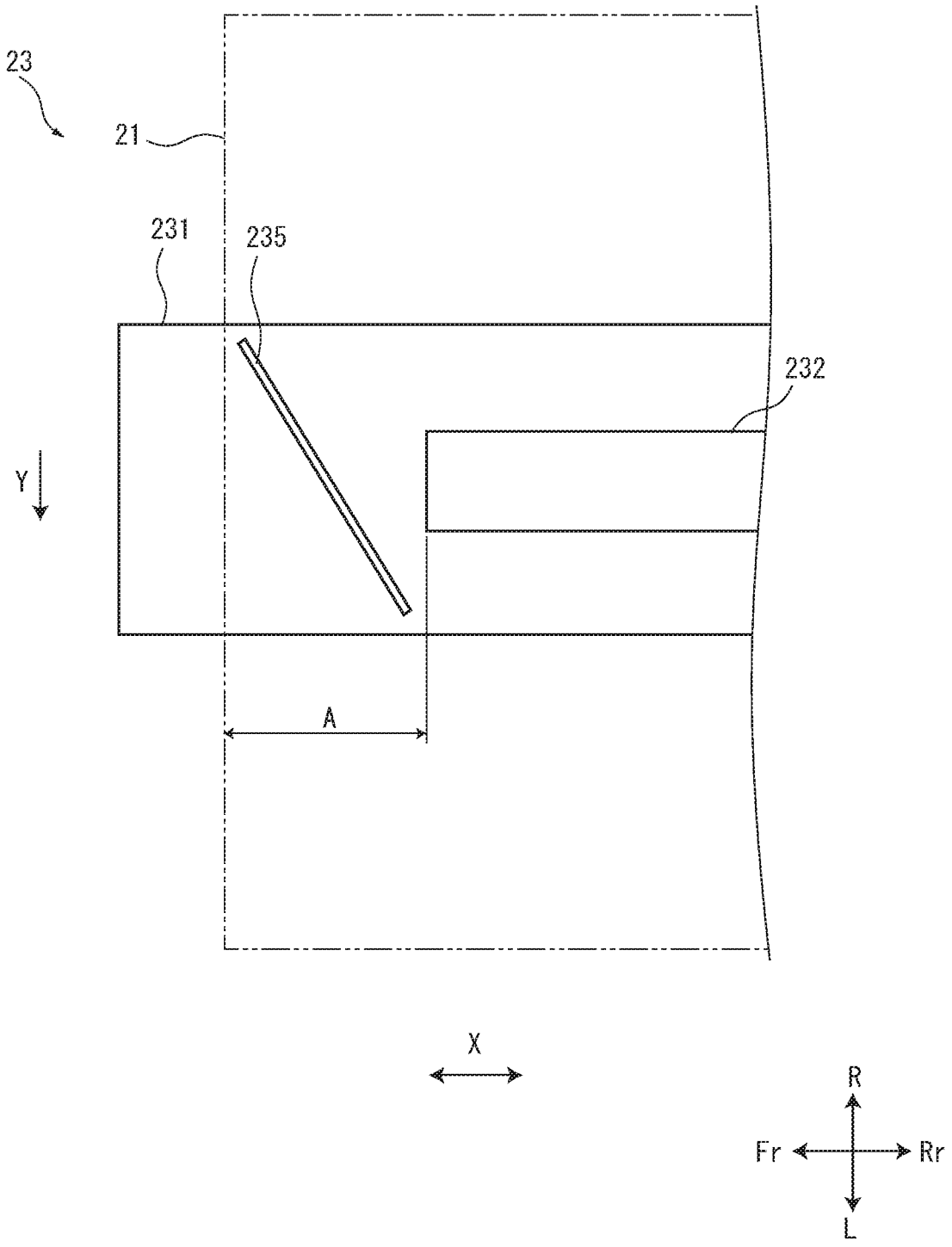
FIG. 13 is a bottom view showing the flat heater according to the embodiment of the present disclosure.

The first, the second, the fifth and the sixth embodiments show an example that the upstream and the downstream end portions of the groove 235 in the rotational direction Y are opened to the upstream and the downstream side faces of the holding body 231. However, as shown in FIG. 13 (the bottom view showing the flat heater 23), the upstream and the downstream end portions of the groove 235 in the rotational direction Y are not always opened to the upstream and the downstream side faces of the holding body 231. Alternatively, one of the upstream and the downstream end portions of the groove 235 in the rotational direction Y may be opened to one of the upstream and the downstream side faces of the holding body 231. The grooves 237 of the third embodiment and the seventh embodiment and the grooves 238 closest to the end portion of the fixing belt 21 of the fourth and the eighth embodiments are the same as the above.

Figure 14:
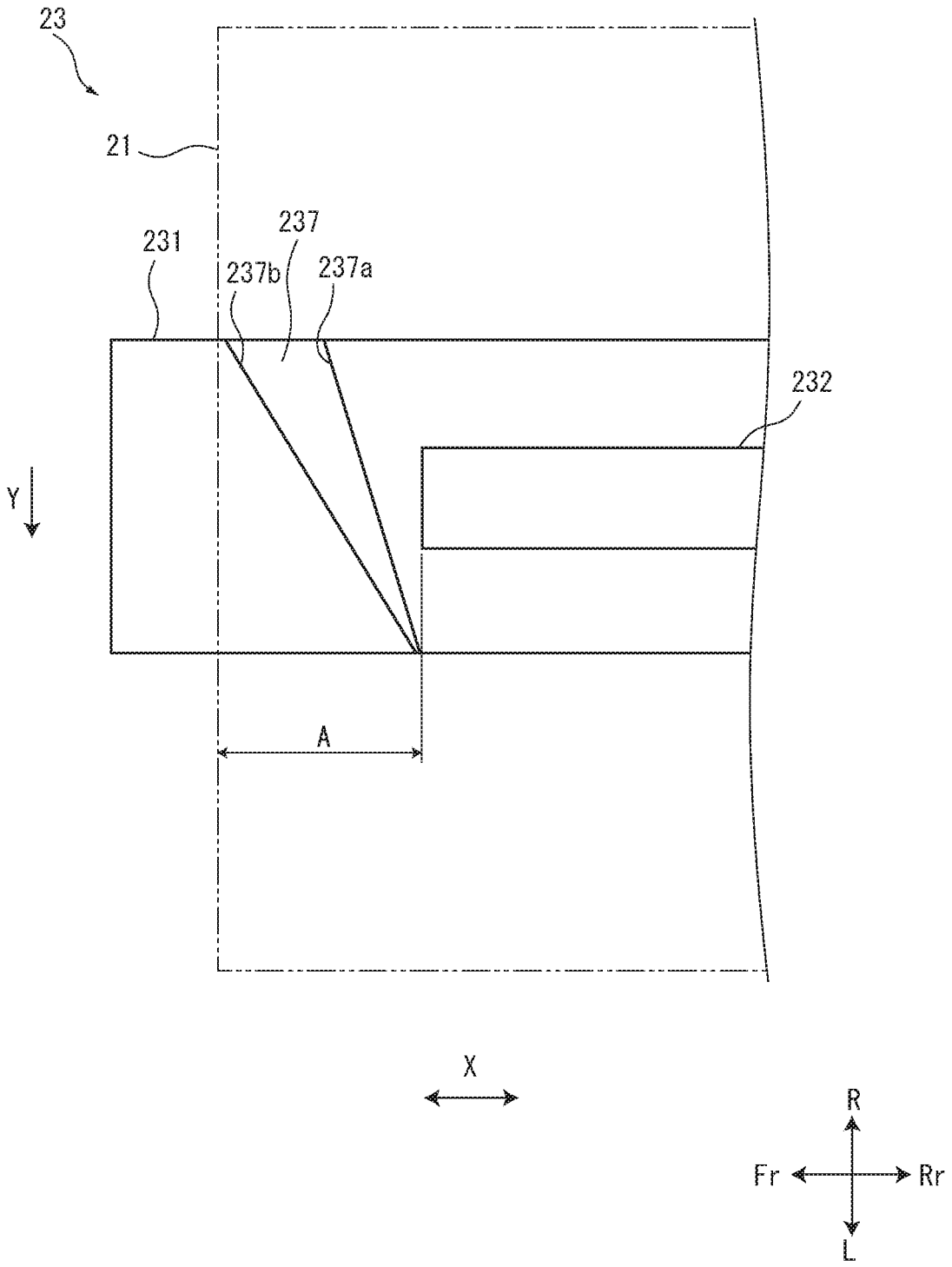
FIG. 14 is a bottom view showing the flat heater according to the embodiment of the present disclosure.

In the third and the seventh embodiments, of the inside edge portion 237*a* close to the heating resistor 232 and the outside edge portions 237*b* far from the heating resistor 232 of the groove 237, the outside edge portion 237*b* is formed to be closer to the center side of the holding body 231 toward the downstream side in the rotational direction Y of the fixing belt 21. However, as shown in FIG. 14 (the bottom view showing the flat heater 23), in addition to the outside edge portion 237*b*, the inside edge portion 237*a* may be formed to be closer to the center side of the holding body toward the downstream side in the rotational direction Y of the fixing belt 21. That is, of the inside edge portion 237*a* and the outside edge portions 237*b* of the groove 237, at least the outside edge portion 237*b* may be formed to be closer to the center side of the holding body 231 toward the downstream side in the rotational direction Y of the fixing belt 21.

The seventh embodiment shows that the inclined face 237*d* reaches the bottom face of the holding body 231 and the inside edge portion 237*a* has not step. However, as shown in FIG. 15 (cross sectional views along a II-II line and a line in FIG. 7), the inside edge portion 237*a* may be formed to be a wall shape perpendicular to the bottom face of the holding body 231.

In the above embodiments, as a cross sectional shape of the groove 235, the box type and the wedge type are described; however, the groove 235 may have a cross section of a U-shape, a V-shape or an arc-shape.

The second embodiment shows that the groves 236 and 235 are parallel to each other; however, the grooves 236 and 235 may not be parallel to each other.

While the above description has been described with reference to the particular illustrative embodiments, the present disclosure is not limited to the above embodiments. It is to be appreciated that those skilled in the art can change or modify the embodiments without departing from the scope and spirit of the present disclosure.

The invention claimed is:

1. A fixing device comprising:

a rotatable cylindrical fixing belt;

a flat heater having a holding body and a heating resistor, the holding body having a longitudinal length longer than a longitudinal length of the fixing belt, the heating resistor having a longitudinal length shorter than the longitudinal length of the fixing belt and being embedded in the holding body such that both longitudinal end portions of the heating resistor are positioned inside longitudinal end portions of the holding body;

a holder configured to hold the flat heater such that a surface in which the heating resistor is embedded comes into contact with an inner circumferential face of the fixing belt via a lubricant, the longitudinal end portions of the holding body are positioned outside the longitudinal end portions of the fixing belt and the longitudinal end portions of the heating resistor are positioned inside the longitudinal end portions of the fixing belt; and a pressing roller configured to hold the fixing belt between the pressing roller and the flat heater to form a pressing area between the pressing roller and the fixing belt, a sheet being conveyed through the pressing area and the fixing belt being driven by the pressing roller to be rotated, wherein of a contact area of the flat heater with the inner circumferential face of the fixing belt, in an area outside the longitudinal end portion of the heating resistor, a groove is formed such that the lubricant flows to a center side of the holding body toward a downstream side in a rotational direction of the fixing belt.

2. The fixing device according to claim 1, wherein the groove is formed to be closer to the center side of the holding body toward the downstream side in the rotational direction of the fixing belt.

3. The fixing device according to claim 2, wherein the groove includes a plurality of grooves, and the grooves are disposed side by side in the longitudinal direction of the holding body.

4. The fixing device according to claim 2, wherein the groove has a linear shape or a curved shape curved toward the center side of the holding body.

5. The fixing device according to claim 1, wherein the groove has an inside edge portion close to the heating resistor and an outside edge portion far from the heating resistor, and at least the outside edge portion is formed to be closer to the center side of the holding body toward the downstream side in the rotational direction of the fixing belt.

6. The fixing device according to claim 1, wherein the groove is formed to become narrower toward the downstream side of the rotational direction of the fixing belt, the groove has an inside edge portion close to the heating resistor and an outside edge portion far from the heating resistor, and at least the outside edge portion is formed to be closer to the center side of the holding body toward the downstream side in the rotational direction of the fixing belt.

7. The fixing device according to claim 1, wherein the groove is formed to become shallower toward the center side of the holding body in a direction crossing to the longitudinal direction of the groove.

8. The fixing device according to claim 1, wherein the groove is formed between an upstream side portion and a downstream side portion of the heating resistor in the rotational direction of the fixing belt.

9. An image forming apparatus comprising:

an image forming part configured to form a toner image on the sheet, and the fixing device according to claim 1, configured to fix the toner image on the sheet.

* * * * *